United States Patent [19]

Jacob

[11] 4,203,777

[45] May 20, 1980

[54] METHOD FOR PURIFYING PARTICULATE MOULD MATERIAL

[76] Inventor: Hermann Jacob, Fachenfelderweg 115, 2105 Seevetal 3, Fed. Rep. of Germany

[21] Appl. No.: 879,868

[22] Filed: Feb. 21, 1978

Related U.S. Application Data

[63] Continuation of Ser. No. 545,014, Jan. 29, 1975, Pat. No. 4,089,081.

[30] Foreign Application Priority Data

Feb. 1, 1974 [DE] Fed. Rep. of Germany ..... 2404702
Dec. 20, 1974 [DE] Fed. Rep. of Germany ..... 2460594

[51] Int. Cl.[2] ..... B08B 1/00
[52] U.S. Cl. ..... 134/7; 134/25 R; 164/5; 165/2
[58] Field of Search ..... 34/7, 15, 31, 32, 37, 34/58, 62, 9, 13, 20, 64, 164, 174, 180, 182, 183; 201/10, 12; 209/134, 135, 196; 164/412, 5; 134/6, 7, 25 R, 30, 37; 15/93 R; 366/118; 51/16; 241/DIG. 10; 165/2, 65

[56] References Cited

U.S. PATENT DOCUMENTS

| | | | |
|---|---|---|---|
| 1,645,317 | 10/1927 | Carroll | 15/93 R |
| 1,787,878 | 1/1931 | Warden-Stevens | 34/20 |
| 2,233,728 | 3/1941 | Bell | 164/5 X |
| 2,420,376 | 5/1947 | Johansson | 34/164 X |
| 2,835,941 | 5/1958 | Muller | 164/5 X |
| 3,686,034 | 8/1972 | Rothschild | 134/25 R X |

FOREIGN PATENT DOCUMENTS 2138531 2/1973 Fed. Rep. of Germany .

OTHER PUBLICATIONS

Giesserei-Praxis, 1961, p. 156.

*Primary Examiner*—Richard V. Fisher
*Attorney, Agent, or Firm*—Michael J. Striker

[57] ABSTRACT

Method for purifying foundry sand which involves the passage of sand through layers of steel wool supported on perforated discs mounted on a vertical shaft in a standpipe. Perforations in the sides of the standpipe permit air to be blown through the sand as it drops down through the steel wool. The vertical shaft supporting the discs and steel wool is vibrated to cause the sand to move through and past the packs of steel wool.

9 Claims, 2 Drawing Figures

Fig.1
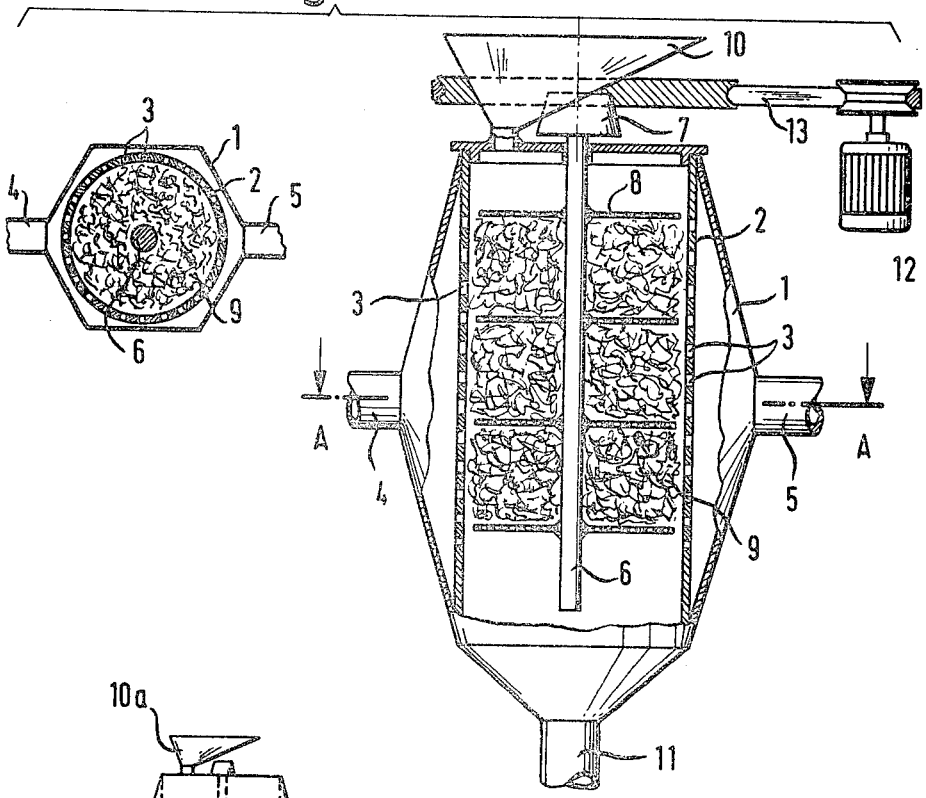
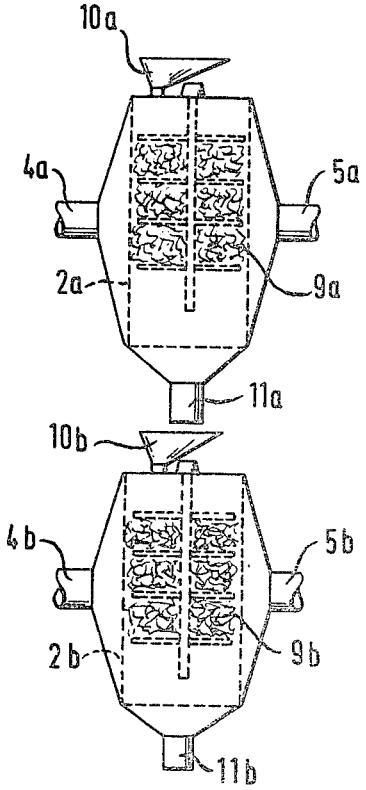
Fig.2

METHOD FOR PURIFYING PARTICULATE MOULD MATERIAL

This is a continuation of application Ser. No. 545,014, filed Jan. 29,1975 and now U.S. Pat. No. 4,089,081.

The invention relates to a process for purifying foundry sand and to apparatus for carrying out the process.

The increasing employment of newly developed moulding processes and ancillary mould materials has necessitated the development of suitable pre-treatment machines. These include installations for regenerating used foundry sands, optionally with simultaneous heat exchange. Repeated use of mould materials is desirable not only on economic but also environmental grounds. Various processes are known, especially for regeneration of mould materials such as sand, which processes as a rule include simultaneous cooling of the sand, the foundry sand fed into the machine having a higher temperature than the air optionally used in carrying out the process. However, the cooling during this process is, as a rule, of subordinate significance to the main purpose of the process which is regeneration.

One such process is described, for example, in "Giesserei-Praxis", 1961, page 156. In this process, regeneration of foundry sand is effected by impact of the sand on a rebound surface, a current of air being used to throw the sand against the surface. Transfer of heat may take place as a result of the contact between air and sand, such that the more or less hot sand is cooled by the air.

The cooling of used foundry sand by passing cool air through it is described in German Offenlegungsschrift No. 2,138,531, but the mere passing of cool air through the sand does not result in regeneration of the sand, and at best only removes loose particles of dust.

Regeneration plants usually have a final stage separation of dust, particularly using stepped- or cascade-purifiers, whereby the sand falls freely from step to step through a current of air and thus undergoes a final purification with simultaneous cooling.

We have now devised an improved process for purifying mould materials such as foundry sand, in which the purification is of improved efficiency and may be achieved simultaneously with transfer of heat, and which process can be carried out in a particularly advantageous manner using very simple apparatus.

According to the present invention, there is provided a process for purifying a particulate mould material such as foundry sand, which comprises contacting the material with metal by feeding the material past contact surfaces and edgesof metal or bringing the material into contact with moving metal particles.

In the process of this invention, very effective, dry contact cooling with simultaneous purification of the foundry sand occurs, where metals of high heat-conductivity and extremely large surface areas (in relation to their volume) are used as contact surfaces. These materials are capable of absorbing heat quickly and well, and also of releasing it again. A large contact surface and, therefore, a large surface area, is very desirable for effective and speedy transfer of heat. This requirement is fulfilled excellently by using shredded or pulverised or splintered or chopped or the like metallic materials, all of which I refer to as "finely divided metallic materials".

Preferably, steel wool or metal wool is used as the purifying- and contact-medium. A collection of finely chopped wire can also be utilised for the same purpose. Metal wool and steel wool do possess an extremely favourable surface/volume ratio and are therefore capable of participating with their large surfaces in the transfer of heat, e.g. to collect heat from the sand in a first stage of the process, and to release it again in a second stage of the process to air.

The transfer of heat aspect of the process of the invention may include passing either fresh (i.e. cool) air or hot air through the metal. Which of the two alternatives is utilised depends upon the temperature of the foundry sand which is to be treated. If foundry sand coming directly from the demoulding is used, i.e. sand with a relatively very high temperature, fresh air will be used to effect a cooling of the sand in addition to purification. On the other hand, if foundry sand is treated which, for example, has been stored and is cold, hot air will be used to raise the temperature of the sand so that it is immediately available for further working.

Whilst treatment of the sand with fresh air to cool it is only useful if the foundry sand contains layers of synthetic resin binding agents, excluding for example, hydrated used foundry sands such as green sand etc., the process according to the invention utilising hot air is also applicable to hydrated used foundry sands.

For the purification of, for example, green sand, the sand is fed past contact surfaces and shredded metal edges or is brought into contact with separate vibrating particles of metal in a first stage of the process whilst, at the same time, hot air is passed through the metal fibres. In a second stage of the process, the sand is once more fed past contact surfaces and edges of shredded metal or is brought into contact with separate vibrating particles of metal, whilst fresh air is passed through the metal fibres. This working method offers the possibility of reducing the water content of the used foundry sand by heating it in the first stage of the process, and of thus drying the used sand, after which it will usually have too high a temperature for immediate further working. For this reason, in the second stage of the process, the sand under renewed purification is subjected to cooling as a result of which the purified sand can be used directly for further working.

Layers of synthetic resin binding agents released during the purification according to the process of the invention, and also particles of dust released, are removed by the hot or fresh air so that the end product of the process is a clean sand suitable for further processing.

The invention includes apparatus for carrying out the process where metal wool or metal fibres are used, which comprises a perforated tube for mounting vertically and axially about a rotatable shaft having a plurality of disc members radially mounted thereon and received within the tube, the disc members being perforated and spaced axially of the shaft to form chambers within the tube for receiving the metal fibres or metal wool, means for vibrating the shaft, means for passing air laterally through the tube, and means for feeding foundry sand into the top of the tube.

By means of this apparatus, it is possible in a simple manner to carry out the process according to the invention in the following way. A grain of sand which is introduced into the vertical tube, the chambers in which have previously been filled with fine steel wool, travels as the pipe vibrates from top to bottom of the tube as it vibrates, passing in contact with the steel wool through the plurality of voids in the same. The grain of sand brushes a large number of sharp edges of the wool and undergoes an additional purification due to the scouring resulting from this brushing contact. Heat is exchanged if there is any difference in temperature between the grain of sand and the steel wool, so that the temperature of the sand in the superimposed levels of the vertical pipe may constantly change. Air passing through the steel wool either takes heat from the steel wool or releases heat to the steel wool, depending on the relative temperatures.

The use of the apparatus is especially advantageous if the foundry sand to be treated has been previously used with organic or inorganic binders. Water has little or no immediate effect on the sand.

For practical purposes, it is desirable if the foundry sand is supplied continuously to the apparatus. Preferably, the feeding means is operable to feed a stream of sand into the top of the tube around the shaft. Suitably, the feeding means is rotatable around the axis of the vertical tube. Using such a device, the shower of sand falling down into the tube forms a spiral, with the steel wool functioning alternately as receiver for heat from the sand and then as dispenser of heat to the cool air. If hot air is used in the process, the steel wool functions firstly as receiver for heat from the hot air and then as dispenser of heat to the sand.

In order that the invention may be more fully understood, one embodiment thereof will now be described, by way of illustration only, with reference to the accompanying drawing, in which:

FIG. 1 is a vertical sectional view, with a horizontal sectional view on A—A; and FIG. 2 is two apparati connected one behind the other for "two-stage" treatment.

Referring to the drawing, in a housing 1 is a vertical standpipe 2. This vertical pipe 2 has perforated walls with air admittable through the perforations 3 which comes from an inlet nozzle 4, enters through the perforations 3 into the interior of the vertical pipe 2 and from there via further perforations 3 leaves the apparatus by an exit nozzle 5.

Inside the vertical pipe 2 there is a vertical structure 6 at the top of which a vertically operating vibratory device 7 is attached. Along the support 6 there are several discs 8 arranged at intervals from each other and firmly connected with the structure 6 and which, together with this, are vibrated by means of the vibratory device 7. Fixed in the spaces between each two discs 8 are metal fibre packs 9, especially of metal wool. These packs 9 are secured by the discs 8, although the discs 8 are equipped with holes or perforations through which the foundry sand falls during vibration.

At the top of the apparatus there is a material feed-device in the form of a filler nozzle 10. This filler nozzle can be arranged in any desired way for rotation around the structure 6. In this way, it is possible to feed the foundry sand continuously to a different place at the top of the apparatus so that the foundry sand falling through the metal fibres of the packs 9 during the vibration of the structure 6, the disc 8 and the metal fibre packs 9, trickles through all metal fibre packs in the form of a spiral-shaped shower.

At the lower end of the apparatus there is a discharge nozzle 11 through which the treated foundry sand is once again removable from the apparatus.

FIG. 2 shows two similar apparati connected one behind the other, in which the discharge nozzle 11*a* of the apparatus technically situated upstream discharges into the feed nozzle 10*b* of the apparatus which is technically situated downstream according to the process and in turn discharges through discharge nozzle 11*b*. Whilst hot air is introduced into the inlet nozzle 4*a* of the upstream apparatus, cool air or fresh air is introduced into the inlet nozzle 4*b* of the apparatus situated downstream. Cooled hot air leaves through the exit nozzle 5*a* after passing through the steel wool packs 9*a*, taking with it dust picked up at the same time as the sand is purified. As against this, heated cool air leaves through the exit nozzle 5*b* after its passage through the steel wool packs 9*b*, removing once more dust gathered during the passage of the sand.

Both in the case of FIG. 1 and FIG. 2 the feed nozzles 10, 10*a* and 10*b* can be displaced in rotation around the longitudinal axis of the vertical pipe 2, 2*a*, 2*b*, for which in the represented case a motor 12 with a belt drive is used.

What I claim is:

1. A method of purifying particulate material, particularly foundry sand, to remove adhering contaminants therefrom, comprising the steps of confining in an enclosed space at least one body of finely divided metallic material having sharp edges and defining a plurality of voids which are bounded by said sharp edges; passing a stream of the particulate material through the enclosed space so that the particles of the material travel through the voids and brush against the sharp edges bounding the same, whereby contaminants adhering to the particles are scoured off by the sharp edges; and withdrawing the scoured-off contaminants to purify the particulate material.

2. A method as defined in claim 1, wherein the metallic material is steel wool.

3. A method as defined in claim 1, wherein the metallic material is metal fibers.

4. A method as defined in claim 1; and further comprising the step of agitating the metallic material to improve the scouring effect of the sharp edges on the particulate material.

5. A method as defined in claim 4, wherein the step of agitating comprises vibrating the metallic material.

6. A method as defined in claim 1, wherein the step of passing comprises feeding the stream of particulate material through said enclosed space under the influence of gravity.

7. A method as defined in claim 1; and further comprising the step of contacting the metallic material with a heat exchange gas.

8. A method as defined in claim 1; and further comprising the step of contacting the metallic material with cool air.

9. A method as defined in claim 1; and further comprising the step of contacting the metallic material with hot air.

* * * * *